United States Patent [19]

Liautaud

[11] Patent Number: 4,881,283

[45] Date of Patent: Nov. 21, 1989

[54] SELF CONTAINED EYE WASH FOUNTAIN

[76] Inventor: John R. Liautaud, 180 Stonegate, Cary, Ill. 60013

[21] Appl. No.: 243,067

[22] Filed: Sep. 9, 1988

[51] Int. Cl.[4] ..... A61H 33/04; B65B 3/04; B67D 3/00

[52] U.S. Cl. ..... 4/620; 141/330; 222/145

[58] Field of Search ..... 4/620; 141/100, 104–107, 141/236, 330, 94; 239/29, 29.3, 543, 545; 222/129.1–129.4, 41, 23, 145; 116/202; 340/540, 568, 679

[56] References Cited

U.S. PATENT DOCUMENTS

| | | | |
|---|---|---|---|
| 1,461,486 | 7/1923 | Kishpaugh | 222/145 X |
| 2,711,268 | 6/1955 | Cannella | 222/145 X |
| 2,955,726 | 10/1960 | Feldman et al. | 222/129.1 |
| 2,962,193 | 11/1960 | Totten | 222/145 |
| 3,001,557 | 9/1961 | Kückens | 222/129.4 X |
| 3,090,050 | 5/1963 | Fraser et al. | 4/166 |
| 3,647,118 | 3/1972 | Johnson et al. | 222/145 |
| 3,930,598 | 1/1976 | Slagle | 222/129.4 |
| 4,012,798 | 3/1977 | Liautaud | 4/166 |
| 4,033,483 | 7/1977 | Neidorf | 222/145 |
| 4,363,146 | 12/1982 | Liautaud | 4/620 |
| 4,383,951 | 5/1983 | Palson | 261/30 |
| 4,432,105 | 2/1984 | Pitroda | 4/597 |
| 4,433,795 | 2/1984 | Maiefski et al. | 222/14 |
| 4,493,119 | 1/1985 | Baumann | 4/620 |
| 4,553,702 | 11/1985 | Coffee et al. | 239/690 |
| 4,606,085 | 8/1986 | Davies | 4/623 |
| 4,641,384 | 2/1987 | Landsberger et al. | 4/620 |
| 4,688,276 | 8/1987 | Allison et al. | 4/620 |
| 4,714,176 | 12/1987 | Wijnen | 222/51 |

*Primary Examiner*—Henry J. Recla
*Assistant Examiner*—Robert M. Fetsuga
*Attorney, Agent, or Firm*—Fitch, Even, Tabin & Flannery

[57] ABSTRACT

A self-contained emergency eye wash fountain. The fountain includes a base having a spray nozzle, upstanding walls defining an open top and a flow channel extending from an inlet end adjacent to the upstanding walls to the spray nozzle. The fountain base holds at least one removable tank containing eye wash liquid. The tank has a mouth adjacent its lower end for providing its contents to a reservoir. If two tanks are used, they are configued so that one drains before the other. The fountain also contains electronic circuitry for indicating that the fountain is ready for use, that the tanks should be replaced because one is empty and for indicating that a predetermined long time has expired since the tanks were mounted. Methods of using the fountain are also disclosed.

15 Claims, 7 Drawing Sheets

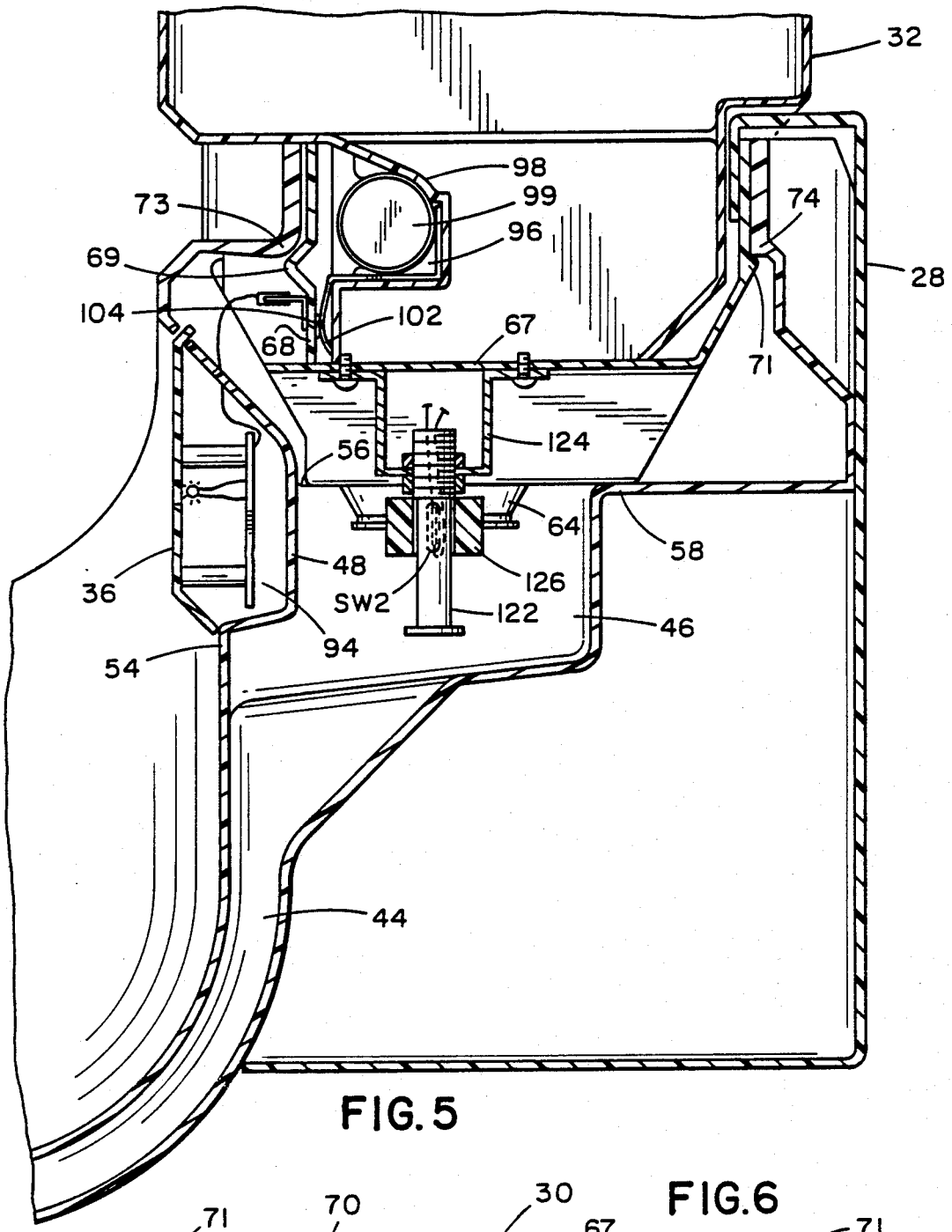
FIG. 5
FIG. 6
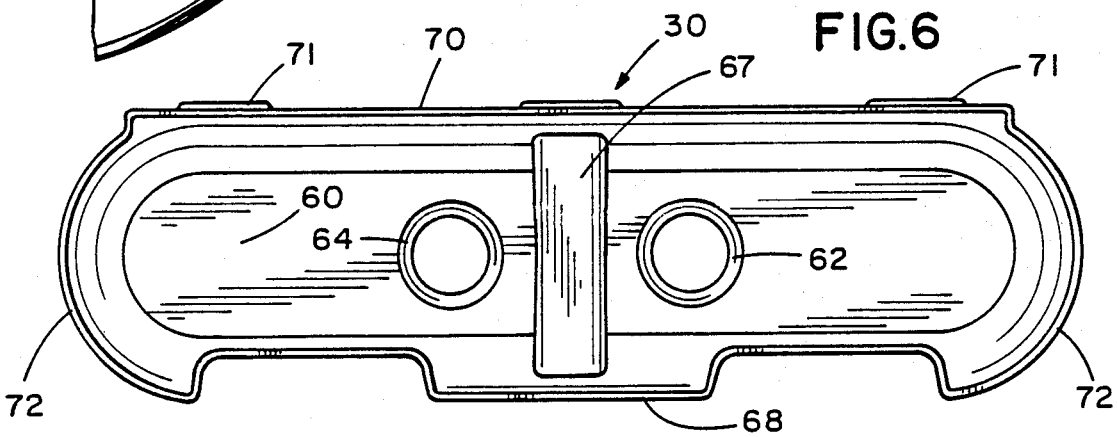

SELF CONTAINED EYE WASH FOUNTAIN

This invention relates to safety apparatus and, more particularly, to an emergency eye wash fountain for flushing foreign matter from the eyes.

BACKGROUND OF THE INVENTION

In the interest of worker safety, emergency eye wash fountains are commonly provided at industrial locations where workers may be subjected to fumes, liquids or particulate matter which can irritate or injure the eyes.

Generally, prior art devices have employed eye wash fountains providing sprays of water from regular plant plumbing connections. Since the use of emergency fountains is normally infrequent, a long period of non-use often results in scale and corrosion build-up in unused pipes which can increase injury if sprayed into the eyes. In addition, water in a plumbing system will often be at a different temperature than a room. Usually cold or warm water can be uncomfortable or even injurious to the user of an eye wash fountain. A distinct disadvantage to these prior art devices is the added expense for installation of the special plumbing connections necessary for the operation of such units.

Particular examples of eye wash fountains such as these appear in U.S. Pat. No. 3,809,315 which discloses nozzle means for preventing surging of water upon initial opening of a valve, U.S. Pat. 3,629,876, which discloses an eye wash fountain having integral nozzles in a basin with valves located on opposite sides of the basin for activation by leaning thereon, and U.S. Pat. No. 3,413,660, which discloses an eye wash fountain having retractable cover members over nozzle outlets for protecting such outlets from air-borne foreign matter.

An improved form of wash fountain is disclosed in my U.S. Pat. No. 4,012,798. There is described an eye wash fountain which is independent of any plumbing connections. The fountain has its liquid reservoir within a hollow portable housing and a pair of generally opposed spray nozzles fixed in a lower portion of the housing in communication with the reservoir. The nozzles are blocked while awaiting use, by caps overlying each of the nozzles and joined together by a pull strap. By grabbing the strap and yanking it outwardly, the worker can release the caps from the nozzles and permit a gravity-induced spray of washing liquid. In this manner, an eye wash fountain was presented which was economical and portable and able to deliver a room temperature wash in comparison to uncomfortable cold water washes provided from plumbed wash fountains. However, this form of wash fountain requires the retention of liquid in the fountain after use. A further disadvantage arises in the troublesome form of pour refilling required for this type of wash fountain.

A further improvement in eye wash fountains is taught by my U.S. Pat. No. 4,363,146. That patent discloses a discrete flow channel in the fountain base and a separate tray for providing eye wash liquid to the flow channel from a removable tank.

This invention provides improvements over the eye wash fountains disclosed in my U.S. Pat. Nos. 4,012,798 and 4,363,146 while still providing a self-contained unit that does not require connection to a remote source of eye wash liquid, and a room temperature flush.

SUMMARY OF THE INVENTION

Among the various aspects and features of the present invention may be noted the provision of an improved emergency eye wash fountain. The fountain of the present invention permits more than one flush but signals a tank is empty. The fountain also provides a signal when a predetermined time has expired from the mounting of a tank of eye wash fluid on the fountain base to indicate that the fluid should be replaced because its effective life may have expired. Additionally the eye wash fountain is self-contained and uses multiple tanks which dispense the eye wash liquid serially. Thus the tanks are easier to handle because of their individual lighter weight in comparison with a single tank having the same amount of liquid. Also only a single tank may require replacement. The first tank to discharge carries batteries so that each time that tank is replaced, a fresh power supply is provided for the electronic circuitry of the fountain. Furthermore, the fountain of the present invention is reliable in use, has long service life, and is relatively easy and economical to manufacture. Other aspects and features of the present invention will be, in part, apparent and, in part, specifically pointed out in the following specification and accompanying drawings.

Briefly, the eye wash fountain of the present invention includes a fountain base having at least one liquid discharge orifice and a reservoir for holding a supply of eye wash liquid, with the reservoir being positioned above the level of the orifice. The fountain also includes at least one tank containing eye wash liquid removably supported by the base. The tank has a mouth adjacent its lower end extending into the reservoir with the mouth being the only opening of the tank. The fountain also includes means for blocking and unblocking the flow of the eye wash liquid from the reservoir to the orifice, and means for measuring the duration of discharge of fluid from the tank to determine when a predetermined amount of liquid has been drained from the tank. Alternatively, the fountain could include at least two separate tanks containing the eye wash fluid with each tank having a mouth adjacent its lower end extending into the reservoir. Furthermore, the fountain can include means for detecting that the liquid in the reservoir has fallen from a higher level toward a lower level thereby indicating that a first tank has been emptied.

As a method, the present invention includes the following steps:

(a) Both time and the use of the eye wash liquid are measured starting when the tanks are mounted on the fountain base;

(b) A signal is provided when the eye wash liquid has flowed for a predetermined time or when a tank is empty;

(c) A signal is provided, after a expiration of a predetermined long time indicating that the tanks should be replaced because the useful life of the eye wash liquid may have expired.

BRIEF DESCRIPTION OF THE DRAWINGS

FIG. 5 is a fragmentary sectional view taken generally along lines 5—5 of FIG. 3;

FIG. 6 is a plan view of the tray of FIG. 2;

Corresponding reference characters indicate corresponding components throughout the several views of the drawings.

DESCRIPTION OF THE PREFERRED EMBODIMENTS

Figure 1:
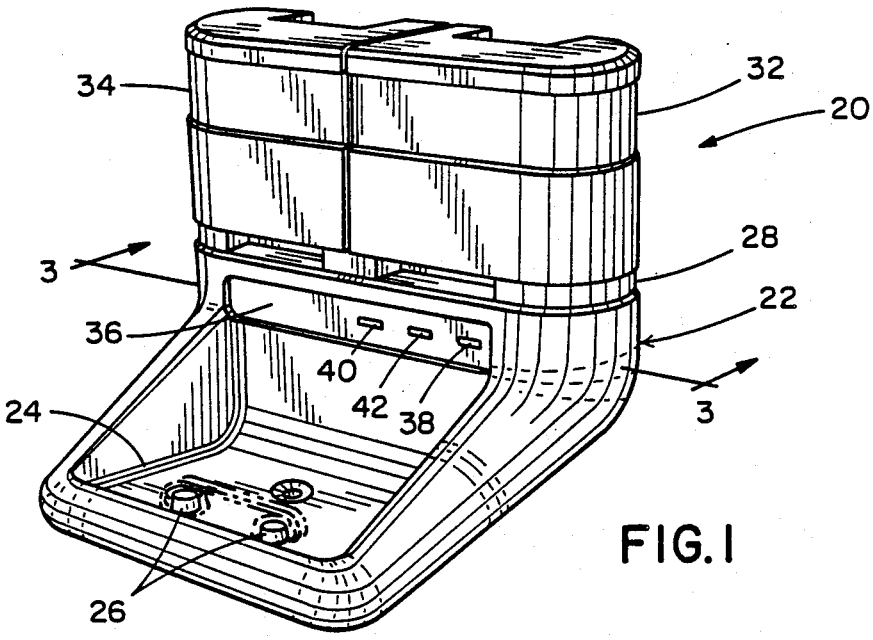
FIG. 1 is a perspective view of an eye wash fountain embodying various features of the present invention.
Figure 2:
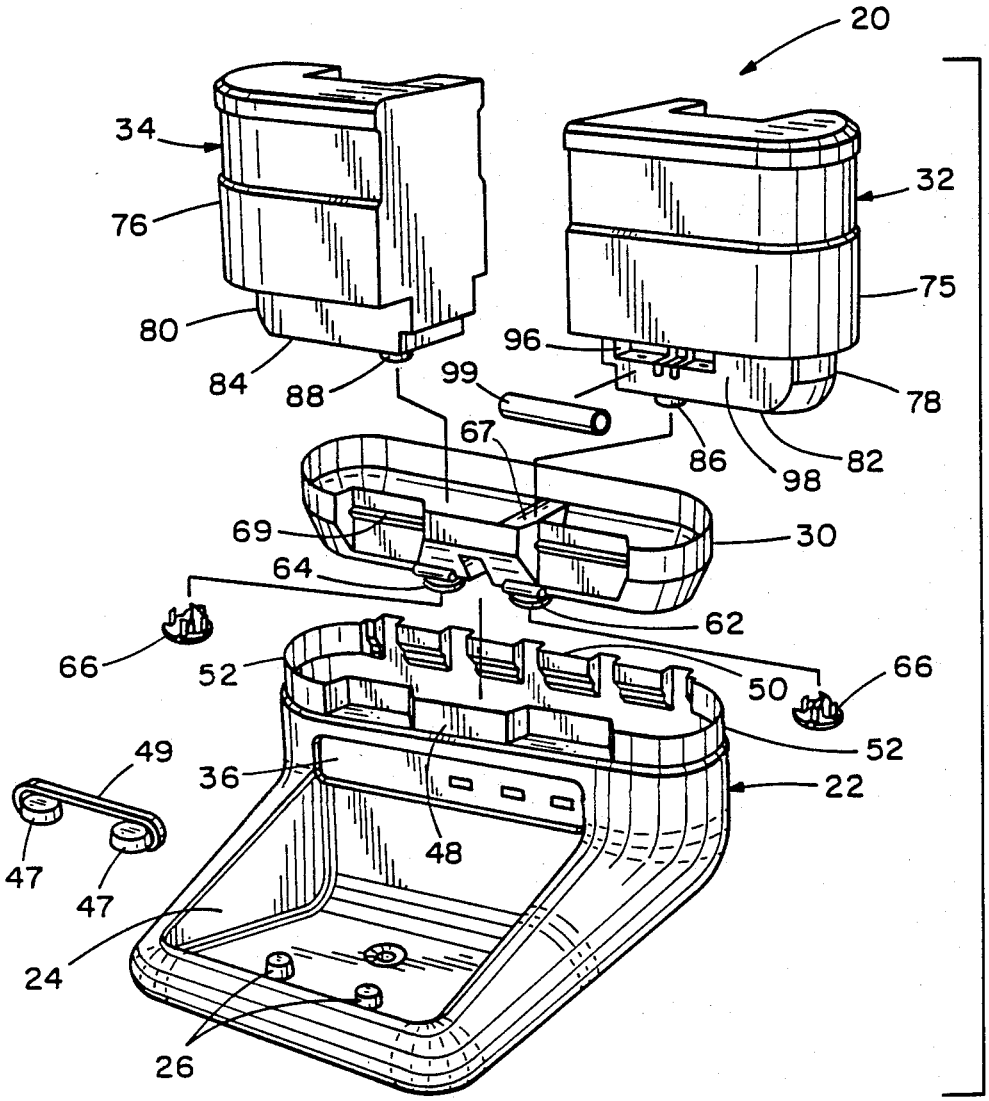
FIG. 2 is an exploded perspective view of the fountain of FIG. 1 showing a fountain base, a tray held in the base and a pair of tanks for supplying eye wash liquid and held by the tray.

Referring to the drawings, an emergency eye wash fountain for providing eye wash fluid to the eyes of, for example, a workman at a chemical factory, is generally indicated in FIGS. 1 and 2 by reference character 20. The fountain 20 includes a fountain base 22 including a basin 24 from which extends upwardly a pair of spaced nozzles 26 each having multiple liquid discharge orifices for providing eye wash liquid. At the rear of the base extends upwardly an open top 28 receiving a tray 30 which in turn supports a pair of tanks 32 and 34 in side-by-side relationship and which are configured to drain in series. Each tank contains a suitable eye wash liquid and, preferably, a physiologically correct, preserved, buffered, isotonic saline solution. While such an eye wash solution does have a long effective life, it may eventually lose its initial properties.

The top 28 carries an indicator panel 36 having different colored lights indicating the status of the fountain 20. For example, illumination of a green light 38 signals the fountain is ready for use, burning of a red light 40 warns that the first tank to drain has emptied and should be replaced, and energization of an amber light indicator 42 that a predetermined long time has passed since the tanks were mounted and they should be replaced because the liquid might have lost some of its initial properties.

More specifically, the fountain base 22 is preferably of one-piece thermoplastic construction and includes flow channel 44, as best shown in FIG. 5, extending from an inlet end or reservoir 46 adjacent the open top 28 to the nozzles 26. The channel preferably has a branch of limited cross sectional area leading to each nozzle to limit the flow rate and to reduce the volume of the fountain base filled with the liquid so that substantially the entire contents of the tanks 32 and 34 is available to be gravity fed to the nozzles. A similar flow channel is shown and described in my U.S. Pat. No. 4,363,146, the teachings of which are hereby incorporated herein by reference.

As shown in FIG. 1, flow of eye wash liquid is blocked until needed by removable sealing means in the form of an elastic cap 47 tightly fitting over each nozzle 26. The caps 47 are connected by a pull strap 49 so that a person desiring to use the fountain 20 only need pull upwardly on the strap to simultaneously remove the cap from both nozzles to cause the liquid to flow. A similar arrangement of caps connected by a pull strap is shown and described in my U.S. Pat. No. 4,012,798, the teachings of which are also incorporated herein by reference.

The open top 28 of the fountain is best shown in FIG. 2 and is defined by an upstanding front wall 48, an upstanding back wall 50, and spaced upstanding side walls 52. The reservoir 46 of the flow channel 44, which underlies and communicates with the volume enclosed by the top 28, is also defined by walls of the base including a lower front wall 54. The fountain base also includes horizontally extending front and rear ledges, 56 and 58, respectively, for supporting the tray 30.

The tray 30, best shown in FIGS. 2 and 6, is preferably of one-piece thermoplastic molded construction. It defines an open end volume and includes a bottom wall 60 having a pair of spaced funnel-shaped outlets 62 and 64 each holding a perforator 66 including a knife blade for rupturing a seal of a respective tank upon locating the tank in the tray. The tray includes a spacer 67 for separating the tanks, as well as upstanding front, back and side walls 68, 70 and 72, respectively for positioning adjacent corresponding walls 48, 50 and 52, respectively, of the top 28. The tray front and back walls have outwardly extending projections 69 and 71 for reception beneath shoulders 73 and 74 of the front end back walls of the top to retain the tray is the top as the tanks are lifted out of the tray.

Figure 3:
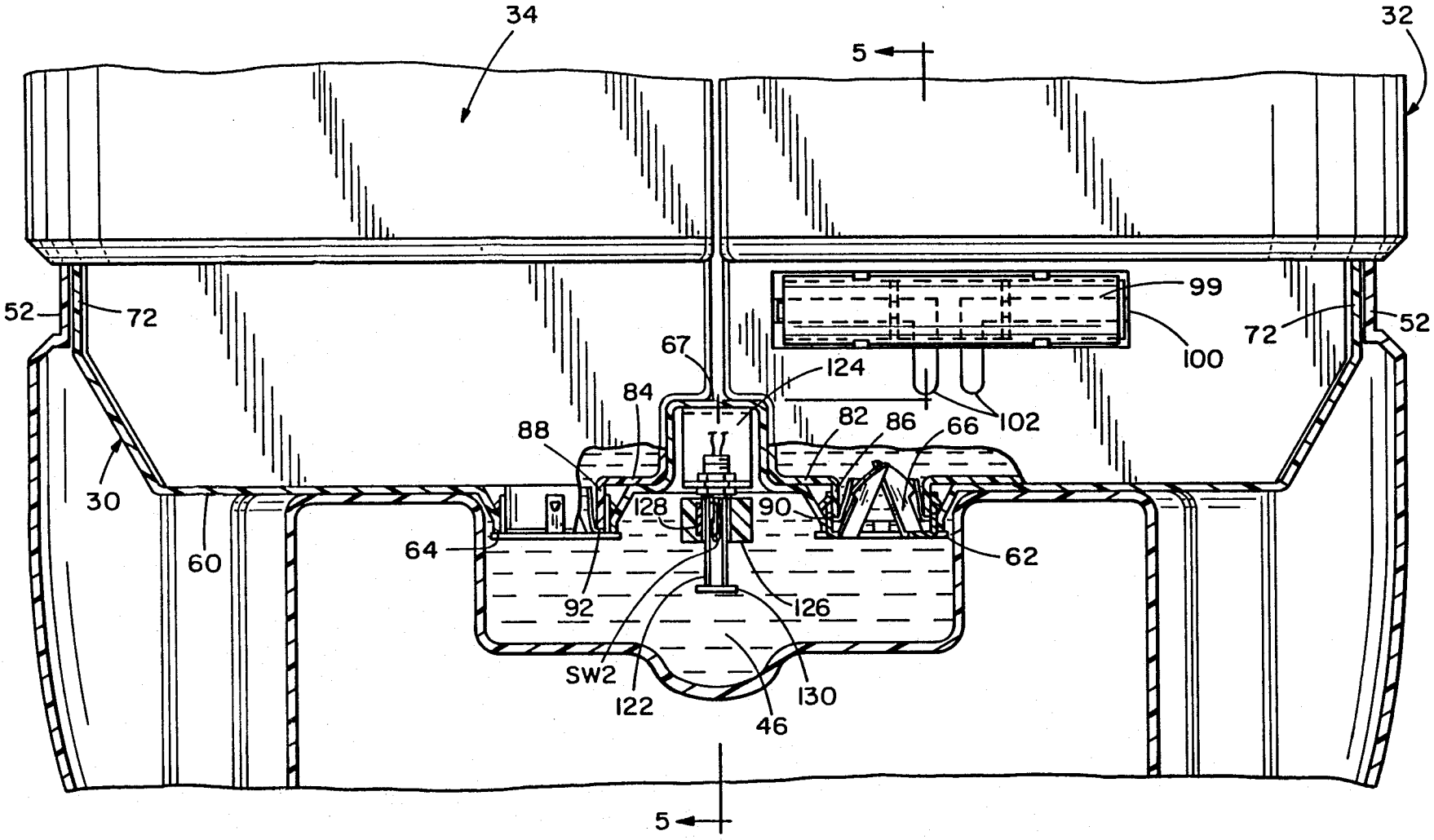
FIG. 3 is a sectional view taken generally along line 3—3 of FIG. 1 showing a high liquid level in a reservoir supplied by the tanks and a float for indicating the level in the reservoir.
Figure 4:
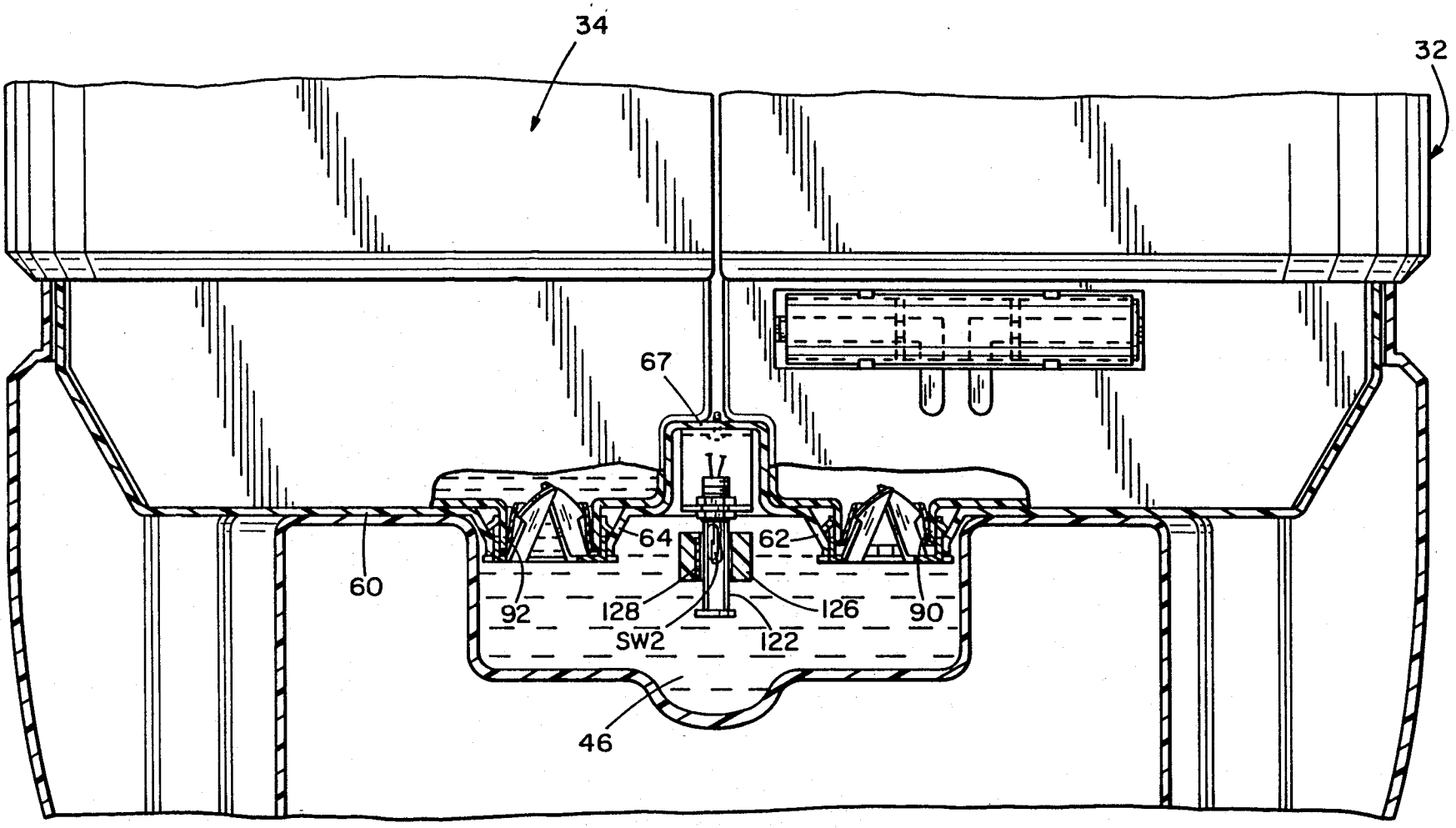
FIG. 4, similar to FIG. 3, shows the reservoir liquid level dropping to a lower level after a first tank empties.

The tanks 32 and 34, best shown in FIGS. 2, 3 and 4, each include an upper tank portion 75, 76 and a lower tank portion 78, 80 of reduced cross section for reception in the tray 30. The tanks include means for causing their contents to drain serially. More specifically each tank includes a bottom wall 82, 84 for positioning against the tray bottom wall 60. Each tank also includes a dependent neck 86, 88 terminating in a mouth 90, 92 which is the only opening of its tank. However the neck 86 of the first tank 32 is shorter than the neck 88 of the second tank 34. In order for a tank to drain, as there is only one opening, air must have access to the interior of the tank to replace the liquid. Each tank is covered with a seal to prevent escape of the eye wash fluid as the tank is moved into position on the tray. When the first tank 32 is mounted, the perforator 66 held in tray outlet 62 ruptures the seal permitting the eye wash liquid to fill the reservoir 46 up to the level of the first tank mouth 90, as shown in FIG. 3, where a liquid seal is formed to prevent additional air from entering the interior of the first tank. When the second tank 34 is mounted, the mouth 92 will be beneath the liquid level in the reservoir 46 so that no air has access to the interior of the second tank.

Upon the user removing the caps 47 for the nozzles 26, the eye wash fluid is dispensed, tending to lower slightly the liquid level in the reservoir so that air can replace liquid in the first tank 32. However the mouth 92 of the second tank 34 remains beneath the liquid level in the reservoir 46 until the first tank 32 is exhausted. Thus the tanks provide their contents in series so that, in appropriate circumstances, only the first tank need be replaced. While two tanks have been discussed above, it is also within the scope of this invention to provide three or more tanks, with at least a first tank having a shorter neck. The use of multiple tanks makes mounting of the tanks easier. For example, each tank may contain about 4 gallons of liquid and have a total weight of about 35 pounds. Two smaller tanks are easier to mount than one large tank which has a weight of about 70 pounds.

Figure 10:
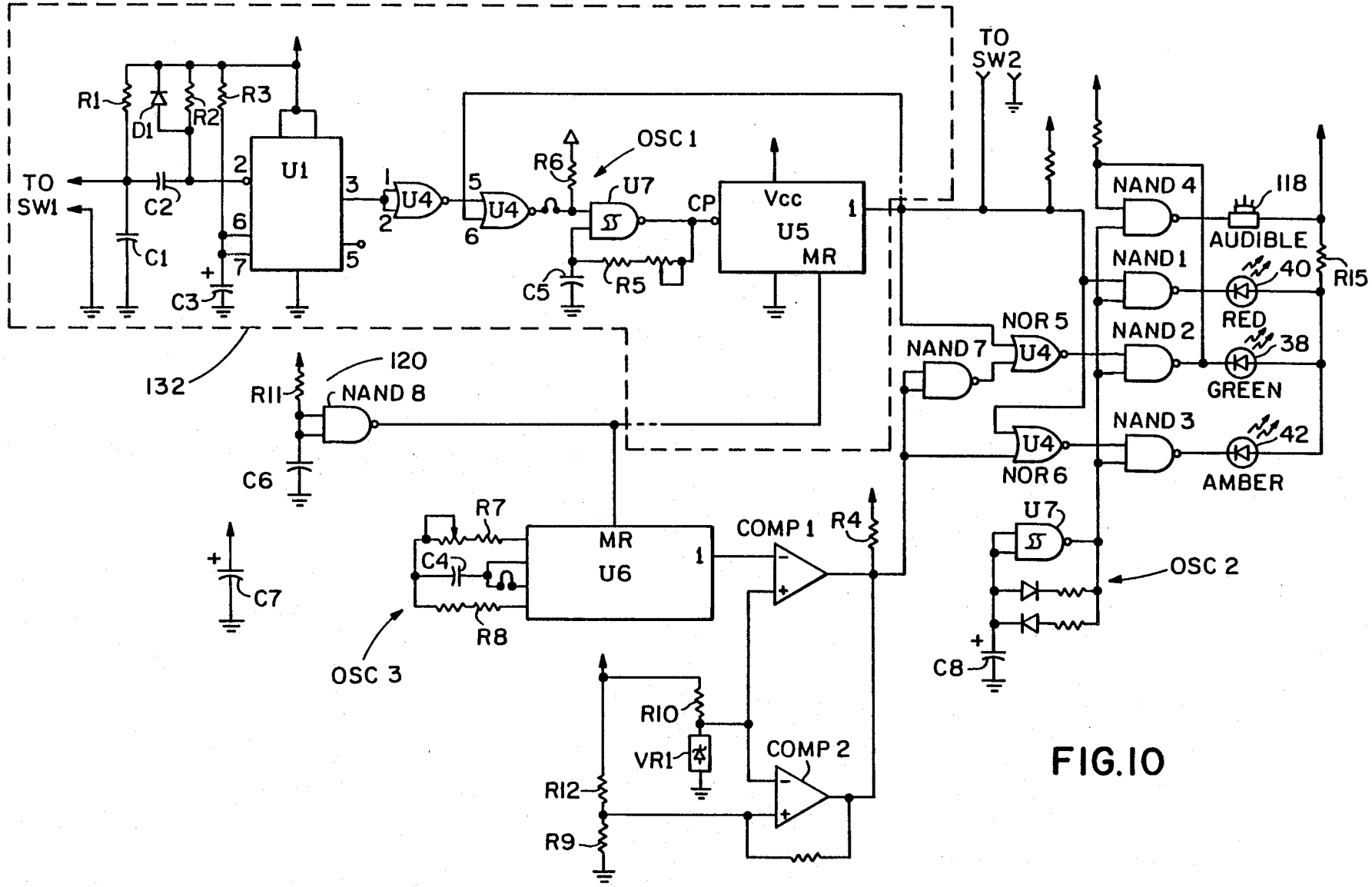
FIG. 10 is an electrical schematic diagram of various circuitry used in either embodiment of the eye wash fountain.

Mounted in recess 94 in the top front wall 48 and covered by indicator panel 36 is electronic circuitry, shown in FIG. 10, for controlling operation of the indicator lights 38, 40, and 42, which are preferably light emitting diodes having colored lenses. The first tank 32 has a recess 96 in a wall 98 defining its lower portion 78 receiving battery means which could be three long life C cell batteries 99 disposed in series. The tank 32 includes appropriate structure for releasably holding the batteries and a connector arrangement 100, including a pair of dependent spring arms 102 for placing the batteries in series and connecting the batteries to the circuitry upon mounting of the first tank. More specifically, the tray 30 includes spaced terminals 104 mounted on its front wall 68 engaging the spring arm upon mounting of the tank 32. Leads are provided connecting the terminals 104 to the circuitry. Thus each time the tanks are replaced, a fresh power supply is provided.

The fountain 20 additionally includes means for detecting that the liquid level in the reservoir 46 has fallen from a higher level, shown in FIG. 3, corresponding to the level of mouth 90 of the first tank 32 to a lower level, shown in FIG. 4, corresponding to the level of the mouth 92 of the second tank 34. This drop in level signifies that the first tank 32 is empty. The detector includes a vertically disposed tube 122 extending into the reservoir 46. The tube 122, made of material previous to a magnetic field, is dependent from a channel-shaped bracket 124 attached to the spacer wall 67 of the tray 30. Mounted inside the tube 122 at a level corresponding to the mouth 90 of the first tank 32 is a reed switch SW2. Disposed for sliding movement about the outside of the tube is a toroidal float 126 carrying a magnet 128 which functions to cause closing of the reed switch when the float is at the higher level, FIG. 3. When the float is at its lower level, FIG. 4, the reed switch SW2 is in an open circuit condition. Thus, opening of the switch indicates that the first tank 32 has emptied. The lower end of the tube 122 has an enlarged foot 130 to retain the float 126.

Figure 7:
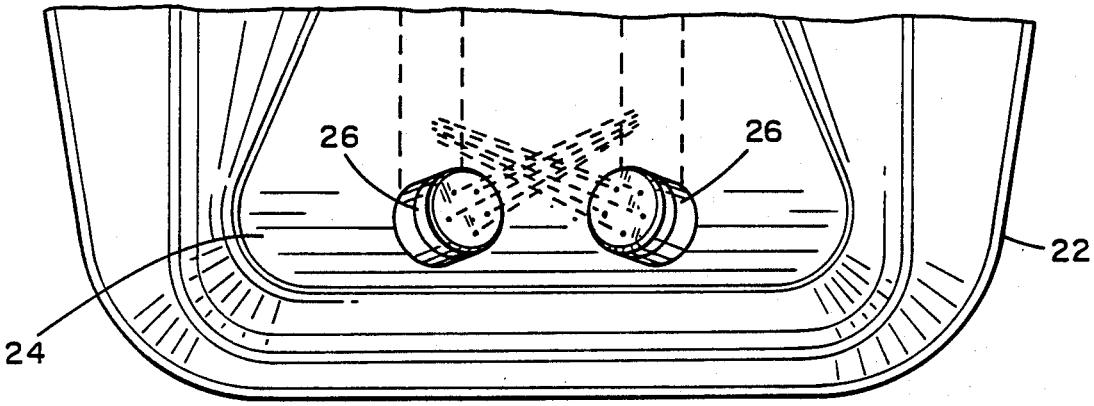
FIG. 7 is a partial plan view of the base with spaced nozzles positioned so that the output of one nozzle does not fall on the other.

Referring to FIG. 7, the nozzles 26 are configured so that the trajectories of their outputs extends somewhat rearwardly. Accordingly, the output of one nozzle 26 does not fall on the other nozzle 26 so as to interfere with the trajectory of the output of the other nozzle.

Figure 9:
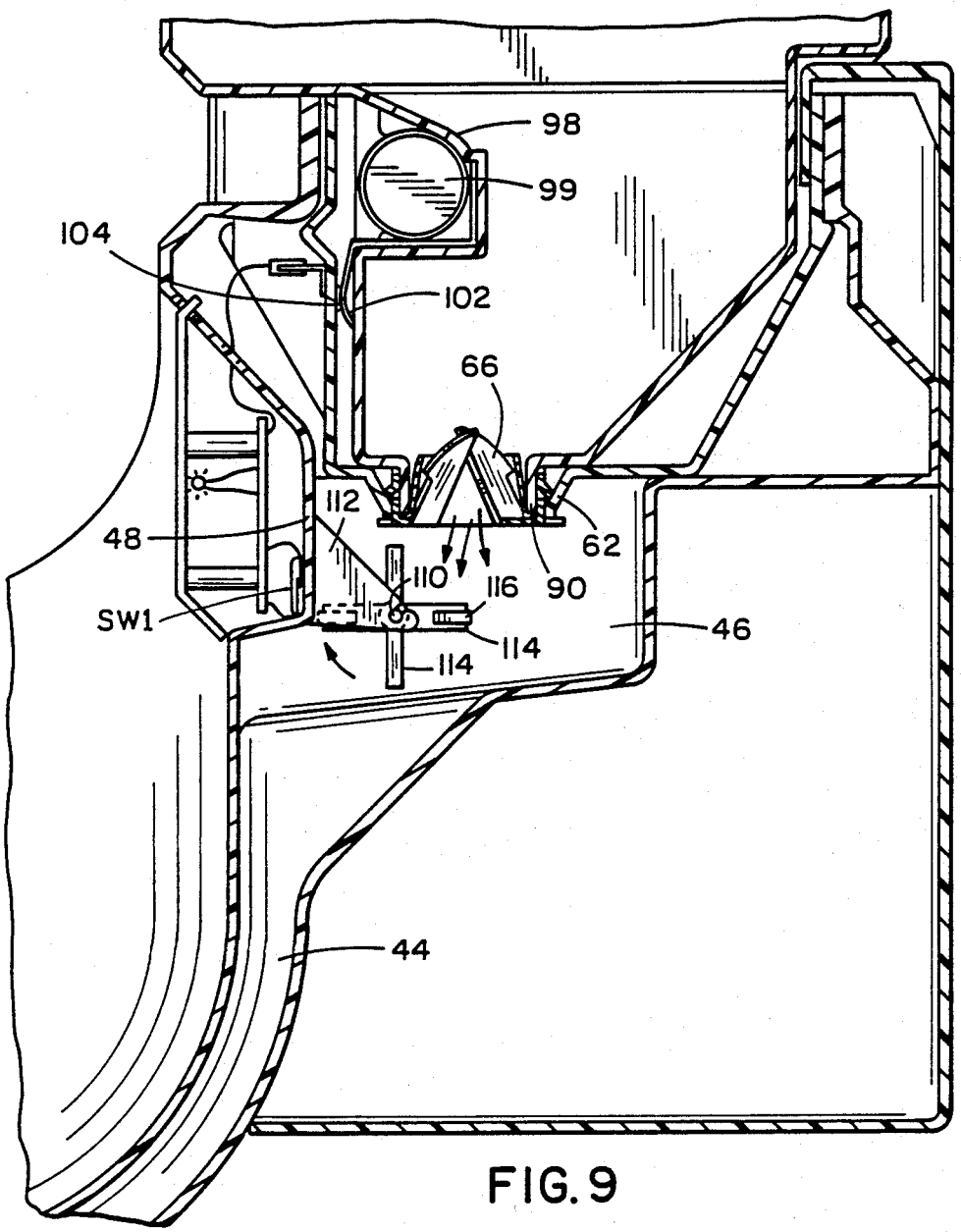
FIG. 9 is a fragmentary cross-sectional view taken generally along line 9—9 of FIG. 8 also showing the mouth of one tank in relation to the paddlewheel.
Figure 8:
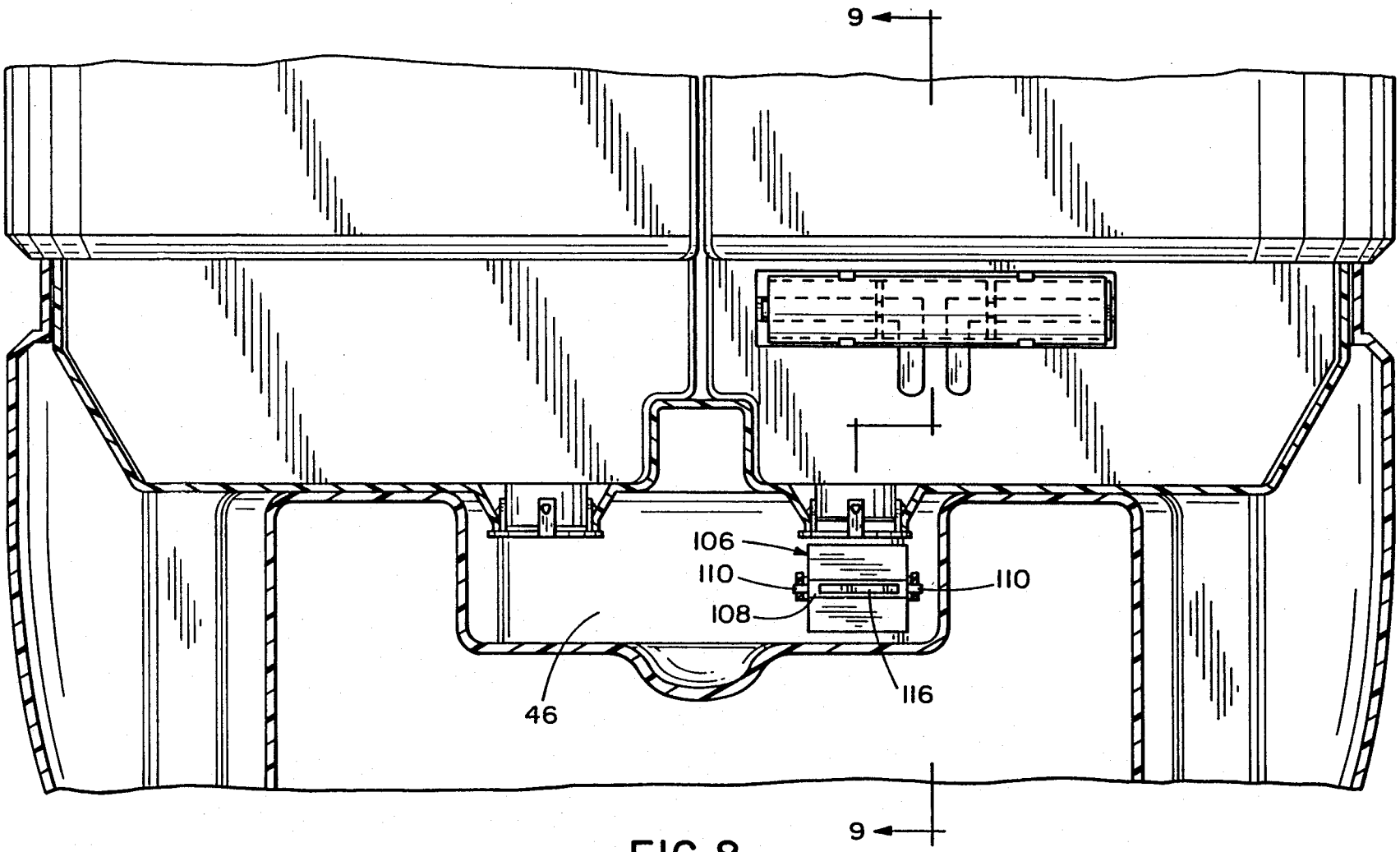
FIG. 8, similar to FIG. 3, shows an alternative embodiment of the eye wash fountain of the present invention in which the mouth of the tank which drains first is aligned with a paddlewheel mounted for rotation when the eye wash liquid flows.

An alternate embodiment of the fountain 20 is shown in FIGS. 8 and 9. In the alternative embodiment means is provided for sensing that eye wash liquid is flowing and measuring the duration of the flow, rather than for detecting a drop in the liquid level in the reservoir 46. While the circuitry required for use with the alternative embodiment is somewhat more complex, the alternative embodiment has an advantage in that it can detect when a predetermined amount of liquid has drained from the first tank 32, in addition to when the first tank is empty.

The alternative embodiment of the eye wash fountain 20, shown in FIGS. 8 and 9, includes means sensing the flow of the eye wash liquid, including a paddlewheel 106 which is rotatably mounted in the reservoir 46. The paddlewheel 106 includes a central body 108 from which axially extends pins 110 rotatably held by arms 112 which are supported by the wall 48 of the fountain base 22 defining the reservoir 46. The paddlewheel includes four spaced radially extending paddles 114 with two opposite paddles carrying permanent magnets 116. The sensing means also includes a sensor positioned adjacent the paddlewheel but spaced from the paddlewheel by a wall of the fountain which is of material previous to the magnetic fields of the magnets. This permits the sensor, which is preferably a reed switch SW1, to be out of the flow channel so that it is non-intrusive to the extent that no wires need penetrate the walls defining the reservoir 46. Reed switches are well known to those of skill in the art and need not be described in detail here. Suffice to say that the contacts of the switch close in the presence of a magnetic field and are biased to open in the absence of such a field. Thus the reed switch provides a switched signal in response to the passage of each magnet 116.

The electronic circuitry and operation of the fountain will first be described in connection with the alternative embodiment of FIGS. 8 and 9. The alternative embodiment requires the use of all the circuitry of FIG. 10, whereas the first embodiment does not require the circuit portion encompassed by the dashed box 132.

Before describing in detail the electronic circuitry of FIG. 10, it should be noted that it may be desirable to determine when a particular amount of liquid is left in both tanks to permit a flush of a predetermined duration. For example, assume the tanks have a combined capacity for 18 minutes and it is desired to signal when 15 minutes of flushing time remains. Thus the fountain can be used for up to 3 minutes and still have sufficient required capacity. Additionally the eye wash solution may lose some of its initial properties after a predetermined time. Assume for purposes of illustration that it is desired to signal after the tanks have been in place for six months.

Referring to the electronic circuitry of FIG. 10, the reed switch SW1 is connected to a timer U1, part number 555C, which is configured so that as long as the reed switch provides a switching signal to pin 2 within a predetermined time, output 3 of timer U1 provides a continuous signal. For this purpose, connected to the inputs of timer U1 is a circuit including a capacitor C2 which charges through a 1 megohm resistor R1 when the reed switch SW1 is closed. Output 3 is connected to the clock pulse input of a counter U5, part number 4040, through an oscillator OSC 1 which provides pulses to the counter as long as timer U1 supplies its output. When the counter U5 accumulates pulses indicating that the fountain has been used for a total of three minutes, it provides a high input on pin 1 which enables gate NAND 1 which controls burning of the red light 40. The other input of gate NAND 1 is connected to an oscillator OSC 2 which controls the flash rate. Oscillator OSC 2 is also connected to inputs of gate NAND 2 which controls operation of green light 38, gate NAND 3 which controls operation of amber light 42, and gate NAND 4 controlling an audible indicator llB. The output pin 1 of timer U5 is also connected to one input of a disable gate NOR 5 for green light 38 and one input of a disable gate NOR 6 for amber light 42.

The circuit also includes counter U6, part number 4521, for long term counting to signal when the predetermined long time, e.g., six months, has expired. Counter U6 may have 24 stages and connected to its inputs is an oscillator OSC 3 which continuously provides pulses. After the predetermined time, e.g. 6 months, counter U6 provides a high output on pin 1 to the inverting input of a comparator COMP 1, the noninverting input of which is connected to a voltage reference in the form of a Zener diode VR 1. The output of comparator COMP1, which switches to provide a low signal when the output of counter U6 goes high, is commonly connected to gate NOR 6 for controlling energization of the amber light 42 and, through an inverter gate NAND 7, to the disable gate NOR 5 for extinguishing the green light 38.

Also connected to the same gates is the output of a comparator COMP 2 which turns on the amber light when the batteries 99 no longer provide a sufficient voltage level. The inverting input of the comparator COMP 2 is maintained at the reference voltage provided by Zener diode VR 1 while the noninverting input is connected to the midpoint of a voltage divider comprising resistors R12 and R9 in series across the batteries. When the voltage level at the junction of R12 and R9 drops below the reference voltage of VR1, comparator COMP2 provides a low signal which energizes the amber light and shuts off the green light.

A power up circuit 120 including a gate NAND 8 is connected to the master reset of each counter U5 and U6 to reset the counters when new batteries are installed. A large capacitor C7 parallels the batteries to provide uninterrupted power to the circuitry when, for example, the fountain might be bumped into or otherwise jostled causing momentary disconnection of the batteries. It will be appreciated that the use of the reed switch results in very low power consumption because when the switch is open it draws no power and, when closed, current only passes through the 1 megohm resistor R1.

Operation of the alternative embodiment of the emergency eye wash fountain 20 embodying various aspects of the present invention is as follows: Upon mounting of a tank 32, the spring arms 102 of the connector arrangement 100 carried by the tank make contact with the terminals 104. This causes the power up circuit 120 to provide a signal to the master reset input of the counters U5 and U6 which immediately starts U6 counting and places U5 in condition to start counting upon receiving signals from timer U1. As the tank is being mounted, the perforator 66 held by the tray outlet 62 ruptures the seal over the tank mouth 90 permitting the eyewash fluid to flow into the reservoir 46. This causes the paddlewheel 106 to start rotating resulting in the reed switch SW 1 switching between an open circuit condition and a closed circuit condition with each passage of a paddle carrying a permanent magnet 116. This opening and closing provides a signal to the timer UI causing it to provide an output which turns on oscillator OSC 1 causing the counter U5 to start accumulating a count. When the flow channel and reservoir fill, the paddlewheel stops which results in timer U1 no longer receiving switch inputs within a predetermined time so that timer U1 no longer provides an output on pin 3. Thus the counting of counter U5 stops.

Until the caps 47 are removed from the nozzles 26 by pulling of the strap 49, the counter U6 continues counting but U5 has stopped. This results in NOR 5 receiving low signals on both of its inputs and therefore providing an enable output to the gate NAND 2 thereby enabling it to flash the green light with every output of the flash rate oscillator OSC 2. The output of NAND 2 is connected as an input to gate NAND 4 controlling actuation of audible indicator 118. Thus as long as gate NAND 2 provides a low output the gate NAND 4 is disabled.

Assuming that the fountain stands unused for the predetermined long period, the counter U6 times out providing a high signal to the inverting input of comparative COMP 1 which is inverted by the gate NAND 7 to disable NAND 2 causing the green light 38 to extinguish and the audible indicator to sound in accordance with the flash rate of oscillator OSC 2. The low output of the comparator COMP 1, along with the low output of the counter U5 causes gate NOR 6 to provide a high output enabling the operation of gate NAND 3, resulting in the amber light 42 flashing in accordance with the output of the oscillator OSC 2. This signals that the tanks should be replaced because the eye wash fluid has been in place the predetermined long time.

On the other hand, if a workman used the eye wash fountain by pulling the strap 49 to remove the blocking caps 47, eye wash fluid would then be gravity fed through the nozzles 26 for the eye flushing. This would cause the paddlewheel 106 to rotate resulting in counter U5 continuing to accumulate its count in accordance with the output of oscillator OSC 1. Assuming that the flush is completed and the caps are replaced before a time, e.g., 2 minutes, so that the predetermined time, e.g., 3 minutes, has not been exceeded, the timer U5 has not timed out and continues to provide its low output on pin 1. However, if the caps 47 are again removed causing the liquid to flow and the paddlewheel to turn with the result that the full count collected by U5 has exceed the total of 3 minutes, the output of pin 1 goes high. This high output enables gate NAND 1, causing operation of the red light 40 so that it flashes in accordance with the flash rate of oscillator OSC 2. The high output of counter U5 also disables gate NOR 5, controlling operation of the green light 38, as well as disables gate NOR 6, controlling the operation of the amber light 42. Thus the red light indication has precedence over both green and amber. Of course with the green light gate NAND 2 providing a high input, the audible indicator 118 is again enabled to provide its audible indication in accordance with the flash rate of the oscillator OSC 2. This of course indicates that the tank 32 should be immediately replaced because there is insufficient fluid remaining for a maximum duration flush. Of course when the tank 32 is replaced, the power up circuit 120 causes both counters U5 and U6 to be reset, thus placing them in condition to start another cycle of operation of the eye wash fountain. It will be appreciated that the count to be accumulated by counter U5 before providing its high output, could be selected to indicate that the tank 32 is empty.

In using the circuitry of FIG. 10 for the first embodiment, wherein the level in the reservoir 46 is detected, there is no need for the counter U5 and its supporting circuitry indicated by the dashed box 132. The operation of the reed switch SW2 can be used to directly control operation of gate NAND 1 and gate NOR 5. Thus when tank 32 empties and the level in the reservoir drops to the level of FIG. 4, the red light 40 flashes, the audible horn 118 sounds, and the green and amber lights are disabled. Other facets of the operation of the circuitry are as described in relation to the alternative embodiment.

As one method of using an emergency fountain having a replaceable tank of eye wash liquid, the present invention includes the following steps:

(a) A measure of both the time and the use of the eye wash liquid when the tank 32 is mounted on the fountain base 22 is started.

(b) A signal is provided, after the eye wash liquid has flowed for a predetermined time, that the tank should be replaced.

(c) A signal is provided, after a predetermined long amount of time has expired after mounting of the tank on the fountain base 22, indicating that the tank should be replaced because certain initial properties of the liquid may have been lost.

As another method of using an emergency eye wash fountain having at least two replaceable tanks of eye wash liquid with the liquid level of the reservoir dropping from a first level to a second level in response to emptying of a first tank, the present invention includes the following steps:

(a) Time is measured starting when a tank is mounted on the fountain.

(b) A signal is provided that a first tank should be replaced when the liquid level drops from the first level.

(c) A signal is provided after a predetermined amount of time after mounting a tank on the fountain that the tanks should be replaced.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A self-contained emergency eye wash fountain for siting without connection to a remote source of eye wash liquid, said fountain comprising:

a fountain base including at least one liquid discharge orifice and a reservoir for holding a supply of eye wash liquid, said reservoir being positioned above said orifice, said base further including a flow channel means connecting said reservoir and said orifice;

at least two separate tanks each containing eye wash liquid supported by sad base and independently removable from said base, each tank having a mouth adjacent its lower end extending into said reservoir, the mouth of each tank being the only opening of that tank, the mouth of one tank being disposed above the level of the other tank, each of said tanks having a bottom wall and a neck dependent from the bottom wall and terminating in said mouth, the neck of said one tank being shorter than the neck of the other tank; and means for blocking and unblocking the flow of the eye wash liquid from said reservoir t said orifice whereby with said means permitting the flow, said one tank drains before said other tank and the level of the eye wash fluid in said reservoir drops from a higher level to a lower level when said one tank has drained.

2. An eye wash fountain as set forth in claim 1 further comprising means for detecting that the liquid in said reservoir has fallen from said higher level.

3. An eye wash fountain as set forth in claim 2 wherein said means for detecting comprises a float which is mounted for movement in said reservoir in response to a change in said liquid level, and a switch the operation of which is controlled by movement of said float.

4. An eye wash fountain as set forth in claim 3 wherein said float carries a magnet.

5. An eye wash fountain as set forth in claim 3 wherein said switch is a read switch.

6. An eye wash fountain as set forth in claim 1 wherein said fountain base includes a support surface disposed above the level of said reservoir for locating the bottom wall of each tank at substantially the same level.

7. An eye wash fountain as set forth in claim 1 wherein said orifice is a component of a spray nozzle means included in said base.

8. A self-contained emergency eye wash fountain for siting without connection to a remote source of eye wash liquid, said fountain comprising:

a fountain base including at least one liquid discharge orifice, a plurality of upstanding side walls defining a top and means for providing liquid extending from an inlet end adjacent said side walls to said orifice;

at least two separate tanks each containing eye wash liquid and each tank being supported by said top and independently removable from said top, each tank having a mouth adjacent its lower end for providing its eye wash liquid to said inlet end of said means for providing liquid;

means causing a predetermined one of said tanks to drain before another of sad tanks; and means for permitting output of said liquid from said orifice when eye washing is needed, said means causing a predetermined one of said tanks to drain before another of said tanks comprising necks on said tanks, the neck leading to the mouth of said one tank being shorter than the neck on another of said tanks so that the mouth of said one tank is disposed above the level of the mouth of another tank.

9. An eye wash fountain as set forth in claim 8 further comprising a separate tray member defining an open volume and having a bottom wall formed with opening means facing said inlet end of said means for providing liquid and sidewalls for positioning adjacent corresponding sidewalls defining said fountain top, said top holding said tray member and said tray member supporting said tanks.

10. An eye wash fountain as set forth in claim 8 further comprising means for sensing the flow of eye wash liquid in said means for providing liquid.

11. An eye wash fountain as set forth in claim 10 wherein said means for sensing the flow comprises a paddlewheel rotatably mounted for rotation in response to the flow of eye wash liquid, said paddlewheel carrying a magnet adjacent its periphery.

12. An eye wash fountain as set forth in claim 11 wherein said means for sensing further includes a sensor responsive to passage of said magnet to provide a signal, said fountain base comprising a wall disposed between said paddlewheel and said sensor so that said sensor is out of the means for providing liquid.

13. An eye wash fountain as set forth in claim 12 wherein said sensor includes a reed switch.

14. An eye wash fountain as set forth in claim 8 further comprising electronic circuitry including means for indicating that said tanks should be replaced because of previous use of the fountain, and means for indicating that the tanks should be replaced because of passage of a predetermined amount of time since the tanks were mounted of said fountain base.

15. An eye wash fountain as set forth in claim 14 wherein at least one of said tanks has a recess in its outer surface for receiving battery means for powering said electronic circuitry.

* * * * *

UNITED STATES PATENT AND TRADEMARK OFFICE

CERTIFICATE OF CORRECTION

PATENT NO. : 4,881,283

DATED : November 21, 1989

INVENTOR(S) : John R. Liautaud

It is certified that error appears in the above-identified patent and that said Letters Patent is hereby corrected as shown below:

Column 5, lines 34-35, change "previous" to --pervious--.

Column 6, line 8, change "previous" to --pervious--.

Column 6, line 59, change "11B" to --118--.

Column 7, line 4, change "VR 1" to --VR1--.

Column 9, line 46, change "sad" to --said--.

Column 9, line 57, change "t" to --to--.

Column 10, line 7, change "read" to --reed--.

Column 10, line 31, change "sad" to --said--.

Signed and Sealed this

Eighth Day of January, 1991

*Attest:*

*Attesting Officer*

HARRY F. MANBECK, JR.

*Commissioner of Patents and Trademarks*